US006792921B2

(12) United States Patent
Forck et al.

(10) Patent No.: US 6,792,921 B2
(45) Date of Patent: Sep. 21, 2004

(54) ELECTRONICALLY-CONTROLLED FUEL INJECTOR

(75) Inventors: Glen F. Forck, Peoria, IL (US); L. Glenn Waterfield, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 26 days.

(21) Appl. No.: 10/319,862

(22) Filed: Dec. 13, 2002

(65) Prior Publication Data

US 2003/0116140 A1 Jun. 26, 2003

Related U.S. Application Data

(60) Provisional application No. 60/341,736, filed on Dec. 17, 2001.

(51) Int. Cl.[7] ..... F02M 37/04

(52) U.S. Cl. ..... 123/498; 123/494

(58) Field of Search ..... 123/498, 494, 123/467, 514, 506, 461, 446; 251/129.06; 239/102.2, 96

(56) References Cited

U.S. PATENT DOCUMENTS

| | | | | |
|---|---|---|---|---|
| 4,175,587 A | | 11/1979 | Chadwick et al. | |
| 4,720,077 A | | 1/1988 | Minoura et al. | |
| 4,748,954 A | | 6/1988 | Igashira et al. | |
| 4,783,610 A | | 11/1988 | Asano | |
| 4,803,393 A | | 2/1989 | Takahashi | |
| 4,813,601 A | | 3/1989 | Schwerdt et al. | |
| 4,887,569 A | | 12/1989 | Igashira et al. | |
| 4,917,068 A | | 4/1990 | Takahashi et al. | |
| 4,927,084 A | | 5/1990 | Brandner et al. | |
| 5,035,360 A | | 7/1991 | Green et al. | |
| 5,199,641 A | * | 4/1993 | Hohm et al. | 239/102.2 |
| 5,203,537 A | | 4/1993 | Jacobs et al. | |
| 5,330,100 A | | 7/1994 | Malinowski | |
| 5,394,852 A | | 3/1995 | McAlister | |
| 5,477,834 A | | 12/1995 | Yoshizu | |
| 5,645,226 A | | 7/1997 | Bright | |
| 5,713,326 A | * | 2/1998 | Huber | 123/299 |
| 5,740,782 A | | 4/1998 | Lowi, Jr. | |
| 5,875,764 A | | 3/1999 | Kappel et al. | |
| 5,986,871 A | | 11/1999 | Forck et al. | |
| 6,062,532 A | * | 5/2000 | Gurich et al. | 251/57 |
| 6,071,088 A | * | 6/2000 | Bishop et al. | 417/322 |
| 6,302,333 B1 | * | 10/2001 | Hoffmann et al. | 239/88 |

FOREIGN PATENT DOCUMENTS

GB 1098087 A1 * 5/2001

* cited by examiner

*Primary Examiner*—Mahmoud Gimie
(74) *Attorney, Agent, or Firm*—Liell & McNeil

(57) ABSTRACT

An electronically-controlled fuel injector includes a pressurized fluid chamber that communicates high pressure fluid to first and second pressure control chambers. A direct-operated check moves between closed and open positions in response to a difference in fluid pressure in the first and second pressure control chambers. A first thermally pre-stressed bender actuator is used to operate a control valve that controls fluid communication between the fluid chamber and a fluid source. A second thermally pre-stressed bender actuator is used to operate a control valve that controls the fluid pressure in the first pressure control chamber to effectively control opening and closing of the check during portions of an injection sequence.

17 Claims, 3 Drawing Sheets

ELECTRONICALLY-CONTROLLED FUEL INJECTOR

RELATION TO OTHER PATENT APPLICATION

This application claims the benefit of provisional patent application 60/341,736, filed Dec. 17, 2001 with the same title.

TECHNICAL FIELD

The present invention relates generally to fuel injector systems and, more particularly, to an electronically-controlled fuel injector.

BACKGROUND

Electronically-controlled fuel injectors are designed to inject precise amounts of fuel into an engine combustion chamber for combustion to generate motive power. The fuel injectors are connected to a fuel tank and include internal fluid chambers, fluid passages, and control valves that communicate fuel through the injector between injection events. During an injection sequence, the control valves move in a predetermined timing sequence to open and close the various fluid passages and fluid chambers so that pressurized fuel is injected into the combustion chamber at the appropriate time from an injection tip of the injector.

In prior fuel injectors, control valves within the injector have been actuated by one or more solenoids that receive control signals from an electronic control. In response to the control signals, the solenoids are operable to cause the control valves to move from one position to another so that fuel is communicated through the injector and to the injector tip in a desired manner. Compression springs may be used to move the control valves to a return position when the control signals are terminated.

In such solenoid-controlled injectors, it is often difficult to accurately control movement and positioning of the control valves through the control signals applied to the solenoids. This is especially true when intermediate positioning of a solenoid-controlled valve between two opposite, fixed positions is desired. Solenoid-controlled valves, by their very nature, are susceptible to variability in their operation due to inductive delays, eddy currents, spring pre-loads, solenoid force characteristics and varying fluid flow forces. Each of these factors must be considered and accounted for in a solenoid-controlled fuel injector design. Moreover, the response time of solenoids limits the minimum possible dwell times between multiple injection events and makes the fuel injector generally more susceptible to various sources of variability.

The present invention is directed to one or more of the problems set forth above.

SUMMARY OF THE INVENTION

While the invention is described in connection with certain embodiments, it will be understood that the invention is not limited to these embodiments. On the contrary, the invention includes all alternatives, modifications and equivalents as may be included within the spirit and scope of the present invention.

In one aspect, a fuel injector includes a spill control valve member and a needle control valve member at least partially positioned in an injector housing. A first electroactive bender actuator is operably coupled to move the spill control valve member. A second electroactive bender actuator is operably coupled to move the needle control valve member.

In another aspect, a method of injecting fuel includes a step of closing a spill valve at least in part by changing a voltage applied to a first electroactive bender actuator. A nozzle outlet is opened at least in part by changing a voltage applied to a second electroactive bender actuator.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION

Figure 1:
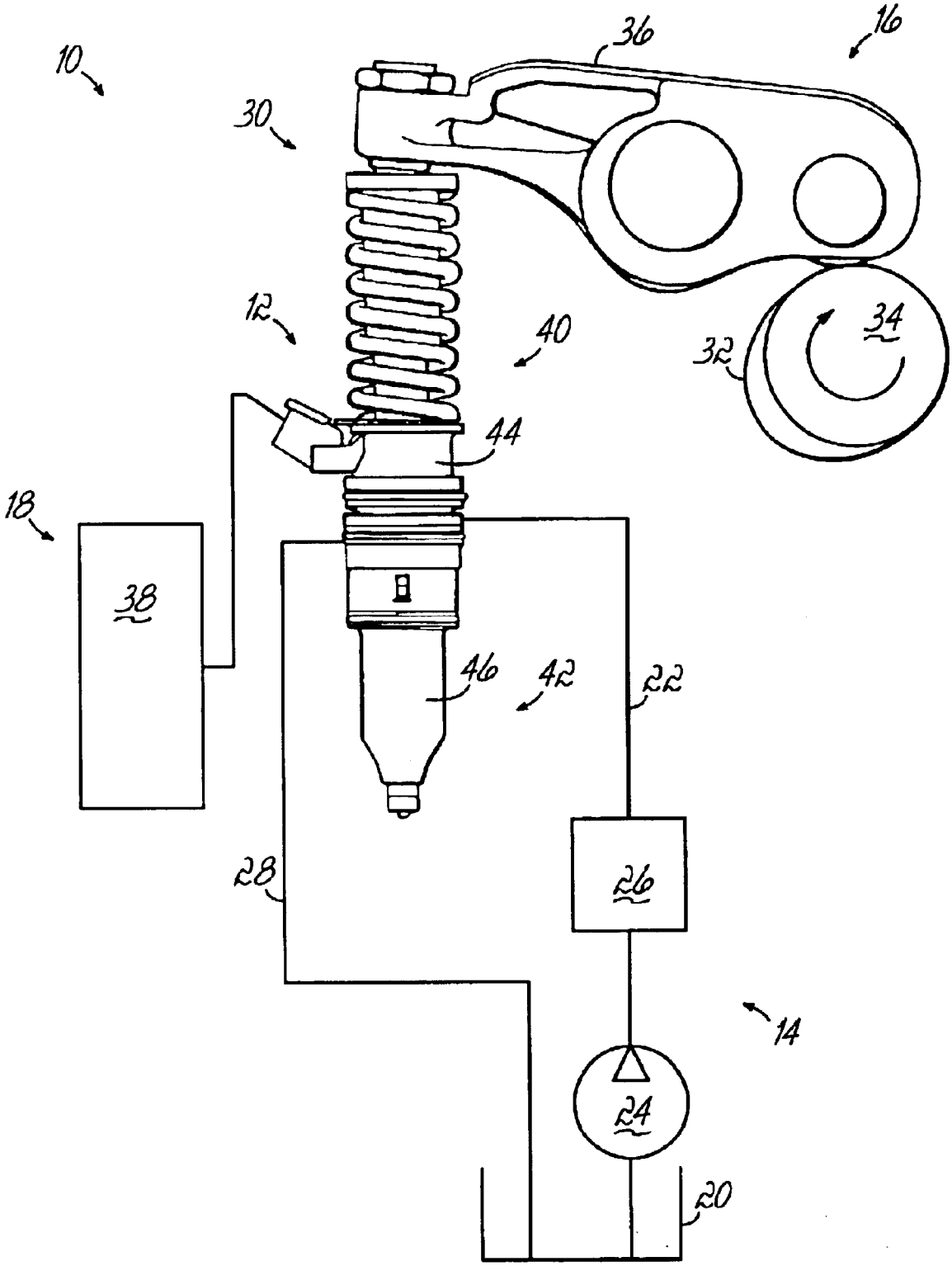
FIG. 1 is a diagrammatic view of an electronically-controlled fuel injector system in accordance with one embodiment of the present invention.

With reference to the Figures, and to FIG. 1 in particular, an exemplary embodiment of an electronically-controlled fuel system 10 for employing the present invention is shown. The exemplary fuel injection system 10 is adapted for a direct-injection diesel-cycle reciprocating internal combustion engine. However, it should be understood that the present invention is also applicable to other types of engines, such as rotary engines, or modified-cycle engines, and that the engine may contain one or more engine combustion chambers or cylinders. The engine typically has at least one cylinder head wherein each cylinder head defines one or more separate injector bores, each of which receives a fuel injector 12 in accordance with one embodiment of the present invention.

The fuel system 10 further includes an apparatus 14 for supplying fuel to each injector 12, an apparatus 16 for causing each injector 12 to pressurize fuel, and an apparatus 18 for electronically controlling each injector 12.

The fuel supplying apparatus 14 typically includes a fuel tank 20, a fuel supply passage 22 arranged in fluid communication between the fuel tank 20 and the injector 12, a relatively low pressure fuel transfer pump 24, one or more fuel filters 26, and a fuel drain passage 28 common with fuel supply passage 22. If desired, the fuel passages may be disposed in the head of the engine in fluid communication with the fuel injector 12 and one or both of the passages 22 and 28.

The apparatus 16 may be any mechanically actuated device or hydraulically actuated device. In the illustrated operating environment, a tappet and plunger assembly 30 associated with the injector 12 is mechanically actuated indirectly or directly by a cam lobe 32 of an engine-driven cam shaft 34. The cam lobe 32 drives a pivoting rocker arm assembly 36 which in turn reciprocates the tappet and plunger assembly 30. Alternatively, a push rod (not shown) may be positioned between the cam lobe 32 and the rocker arm assembly 36 by ways known to those skilled in the art. Although the illustration of FIG. 1 shows the cam as having the single lobe, those skilled in the art will appreciate that the cam may have more than one lobe, such as an additional lobe for producing homogenous charge injection events. Such injection events typically take place early in the compression cycle when the engine piston is closer to a bottom position than to a top position. In addition to being cam actuated, the present invention could also utilize hydraulic actuation or a combination of the two. For instance, pressurized fluid, such as fuel or lubrication oil, could be used to cause the plunger to be driven downward to pressurize fuel to injection levels for an injection event. In a hybrid version, a rotating cam could cause an intervening fluid to act as a sort of push rod between the cam and the injector plunger. In addition, the fuel pressurization portion of the fuel injector could be separated from the nozzle portion, such as by utilizing units pumps. Thus, those skilled in the art will appreciate that the present invention can take on a variety of different structures without departing from the intended scope of the present invention.

The electronic controlling apparatus 18 preferably includes an electronic control module (ECM) 38 which typically controls: (1) fuel injection timing and pressure; (2) total fuel injection quantity during an injection cycle; (3) the number of separate injection segments during each injection cycle, (4) the time interval(s) between the injection segments; and (5) the fuel quantity delivered during each injection segment of each injection cycle.

Figure 2:
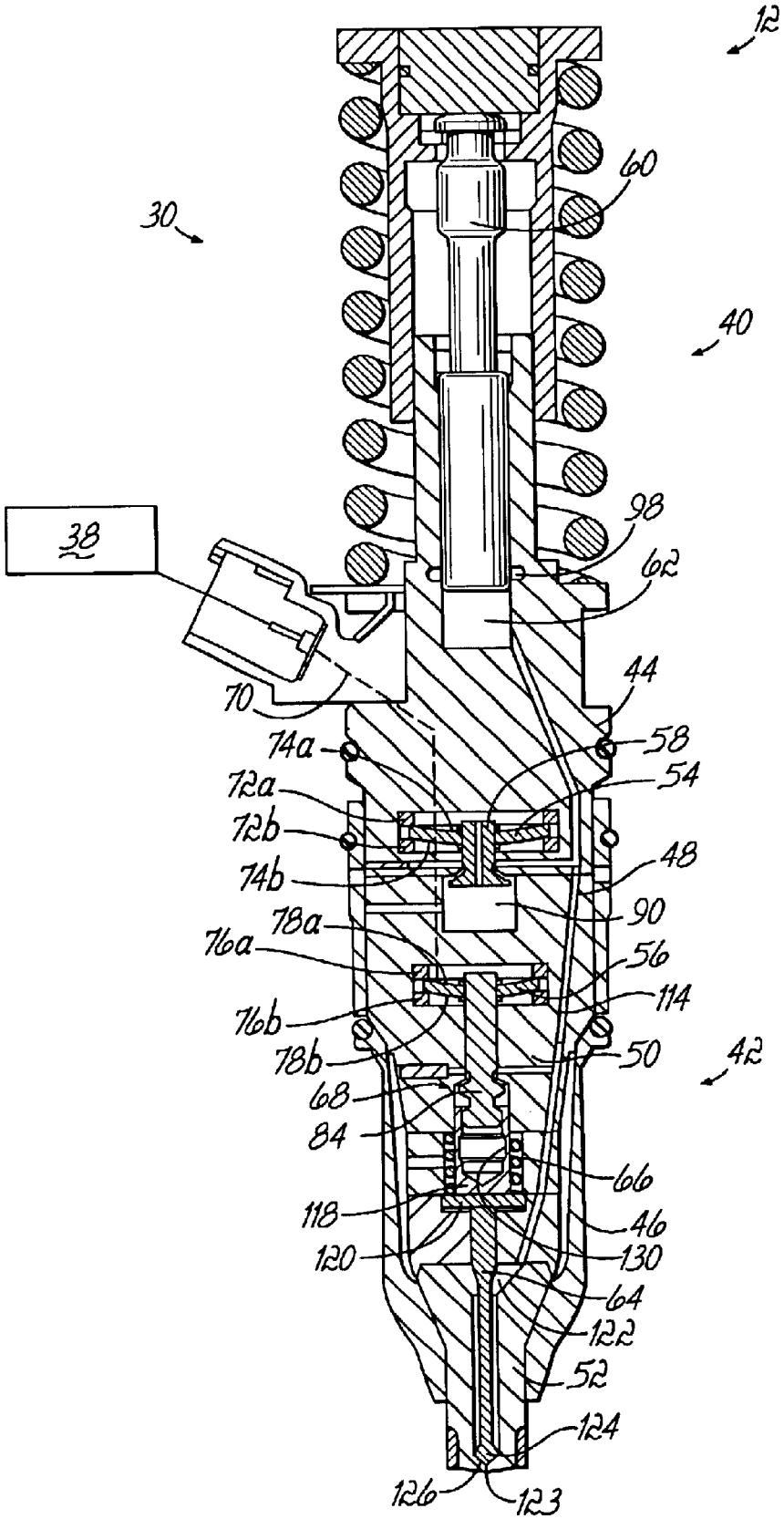
FIG. 2 is an enlarged cross-sectional diagrammatic view of the fuel injector shown in FIG. 1.

Each injector 12 is typically a unit injector wherein both a fuel pressurization portion 40 and a fuel injection portion 42, e.g. a nozzle portion, are housed in the same unit. In the illustrated embodiment, the fuel pressurization portion 40 includes a housing 44 for operatively supporting the tappet and plunger assembly 30. Referring to FIG. 2, the fuel injection portion 42 typically includes an outer casing 46 operatively coupled with the housing 44, an upper body 48, a lower valve body 50, and a tip member 52. Although shown as a unitized injector 12, the injector 12 could alternatively be of a modular construction wherein the fuel injection portion 40 is separate from the fuel pressurization portion 42, which could be a portion of the unit pump.

The injector 12 includes a first electrically-operated valve actuator 54, a second electrically-operated valve actuator 56, a high pressure spill or control valve member 58, a plunger 60 disposed in a plunger cavity or fluid chamber 62, a check 64, a check spring 66, and a needle valve 68.

In accordance with one embodiment of the present invention, valve actuators 54 and 56 comprise thermally pre-stressed electroactive bender actuators that change shape by deforming in opposite axial directions in response to a control signal applied by the ECM 38. The control signal may be, for example, a voltage signal applied from the ECM 38 to the valve actuators 54 and 56 though a pair of electrical conductors 70 (shown in phantom in FIG. 2). Each bender actuator 54 and 56 typically has a cylindrical or disk configuration and includes at least one electroactive layer (not shown) positioned between a pair of electrodes (not shown), although other configurations are possible as well without departing from the spirit and scope of the present invention. In a de-energized or static state, each bender actuator 54 and 56 is typically thermally pre-stressed to have a domed configuration as shown in FIG. 2. When the electrodes are energized to place the bender actuators 54 and 56 in an actuated state in response to a control signal of a first polarity, such as when a voltage control signal of a first polarity is applied by the ECM 38, the bender actuators 54 and 56 displace axially by flattening out from their respective domed configurations, for example, although increased doming is also possible. The bender actuators 54 and 56 are bi-directional so that an applied control signal of an opposite polarity will cause each bender actuator 54 and 56 to flex or dome to a greater extent from its static domed state. Accordingly, it will be appreciated that the orientation of one or both of the bender actuators 54 and 56 could be reversed without departing from the spirit and scope of the presentation. Examples of thermally pre-stressed actuators 54 and 56 suitable for use in the present invention are described in U.S. Pat. Nos. 5,471,721 and 5,632,841. Valve actuators 54 and 56 may comprise a plurality of bender actuators (configured in parallel or in series) that are individually stacked or bonded together into a single multi-layered element.

Each of the electroactive bender actuators is preferably on a separate electrical circuit so that each can be energized completely independent of the other. However, the present invention also contemplates having both electroreactive bender actuators on a single electrical circuit. In such a case, the biases and associated valve members would be preferably constructed such that a voltage at a certain magnitude would deform the bender sufficiently to close one valve but not both. A voltage at a larger magnitude would then be used to move the other valve member its remaining distance to close it while the first valve remained in its closed position.

In one embodiment of the invention, valve actuator 54 is mounted between and supported by a pair of locking rings 72*a* and 72*b* (FIGS. 2 and 2A) that are each configured to clamp opposed major surfaces 74*a* and 74*b* (FIG. 2A), respectively, of the actuator 54. Likewise, valve actuator 56 is mounted between and supported by a pair of locking rings 76*a* and 76*b* (FIGS. 2 and 2A) that are each configured to clamp opposed major surfaces 78*a* and 78*b* (FIG. 2A), respectively, of the actuator 56. The locking rings 72*a*, 72*b* and 76*a*, 76*b* preferably have a cylindrical configuration and are disposed in cavities formed in the housing 44 and the upper body 48, respectively. The clamping load applied to the bender actuators 54 and 56 may be varied by varying the axial dimensions of the locking rings 72*a*, 72*b* and 76*a*, 76*b*, respectively, to change the axial displacement characteristic of the bender actuators 54 and 56 in response to a predetermined control signal. For example, if the axial dimensions of the locking rings 72*a*, 72*b* and 76*a*, 76*b* are increased, a greater clamping load will be applied to the actuators 54, 56, respectively, that will result in a reduced axial displacement of the bender actuators 54 and 56 in response to a predetermined control signal magnitude. Conversely, less clamping of the actuators 54 and 56 adjacent their respective peripheral edges will allow greater axial displacement in response to a control signal of the same magnitude.

Figure 2A:
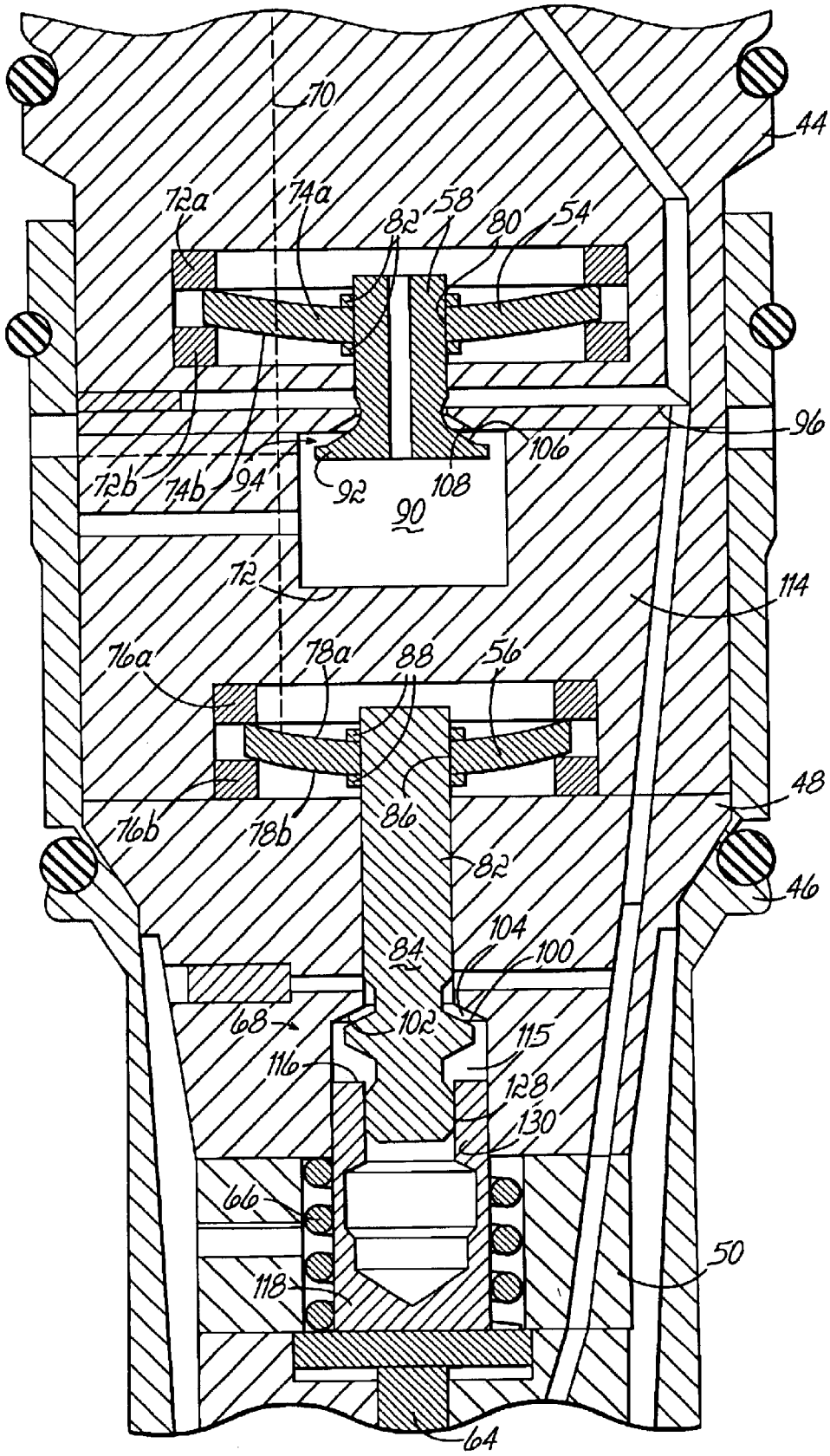
FIG. 2A is an enlarged diagrammatic view of the valving portion of the fuel injector shown in FIG. 2.

As shown in FIGS. 2 and 2A, the spill valve 58 extends through a bore 80 (FIG. 2A) formed through the bender actuator 54 and is fixed to the actuator 54 through a pair of locking collars 82 (FIG. 2A) that contact the surfaces 74*a*, 74*b* of the actuator 54 and may be threaded, welded, glued or otherwise fastened to the spill valve 58. A valve stem or poppet 84 of the needle valve 68 extends through a bore 86 (FIG. 2A) formed through the bender actuator 56 and is fixed to the actuator 56 through a pair of locking collars 88 (FIG. 2A) that contact the surfaces 78*a*, 78*b* of the actuator 56 and may be threaded, welded, glued or otherwise fastened to the DOC valve stem or poppet 84.

Prior to the time that injection is to occur, the electroactive bender actuators 54 and 56 are de-energized or are each caused to flex or dome to a greater extent in response to an applied control signal of a first polarity, thereby opening the spill valve 58 and needle valve 68. Fuel circulates from the transfer pump 24 (FIG. 1) and the fuel supply passage 22 into internal passages (not shown) of the fuel injector 12 which connect with a chamber 90 (FIG. 2A) disposed below a shoulder portion 92 of the spill valve 58. The fuel passes through a fluid passage 94 (FIG. 2A) of the open spill valve 58 into a space 96 above the spill valve 58 and thereafter through one or more additional passages (not shown) to the plunger cavity or fluid chamber 62.

Also at this time, the DOC needle control valve member 84 is disposed in an open position in which a sealing surface 100 of the needle control valve member 84 is spaced away from a valve seat 102 defined by the lower valve body 50 to create a fluid passage 104 (FIG. 2A).

During a portion of an injection sequence to accomplish fuel injection, a control signal, e.g., a voltage signal of a first magnitude, is applied generally simultaneously from the ECM 38 to the valve actuators 54 and 56.

Assuming a single electrical circuit, the initial control signal causes the actuator 54 to displace a first distance that effectively closes the fluid passage 94 (FIG. 2A) of the spill valve 58. In the closed position of spill valve 58, a sealing surface 106 (FIG. 2A) of the shoulder portion 92 contacts a seat 108 (FIG. 2A) of the housing 44 to close fluid passage 94. In response to the initial control signal applied by the ECM 38, the actuator 56 also displaces axially in a direction toward the spill valve 58, but its axial displacement is not sufficient to cause the sealing surface 100 to contact the seat 102, and therefore the needle valve 68 remains open.

Subsequently, fuel is pressurized by downward movement of the plunger 60 in the plunger cavity 62. The pressurized fuel is conducted through a high pressure fuel passage 114, and also through fluid passage 104 between the sealing surface 100 and seat 102 via a cross drilled hole (not shown), to a first pressure control chamber 115 and against an upper surface 116 (FIG. 2A) of a DOC piston 118. The DOC piston 118 in turn bears against a spacer 120 which abuts a top end of the check 64. The fuel passage 114 further conveys pressurized fluid to a check passage or second pressure control chamber 122. Accordingly, the fluid pressures across the check 64 are substantially balanced, and thus the check spring 66 keeps the check 64 in the closed position such that a check tip 124 bears against a seat 126 of the tip member 52 to close injection orifice 123.

During an injection, a control signal is changed, such as to have a higher magnitude voltage signal, and is applied generally simultaneously by the ECM 38 to the valve actuators 54 and 56 to cause the bender actuator 56 to further flatten out or deform in the axial direction while the spill valve 58 operated by bender actuator 54 remains seated or closed. This further displacement of the bender actuator 56 moves the needle control valve member 84 axially toward the spill valve 58 and causes the sealing surface 100 to contact the seat 102 to close fluid passage 104. Fluid captured in the first pressure control chamber 115 above the upper surface 116 of the DOC piston 118 bleeds via a controlled leakage path between a head portion 128 (FIG. 2A) of the needle control valve member 84 and a wall 130 (FIG. 2A) of the DOC piston 118 and through a passage (not shown) extending through the side walls of the DOC piston 118 to drain. A low pressure zone is thereby established in the first pressure control chamber 115 above the DOC piston 118, thereby causing the check 64 to move upwardly to initiate fuel injection through the injection orifice 123 as a result of the difference in fluid pressure in the first and second pressure control chambers 115, 122.

When injection is to be terminated, the control signal applied to the valve actuators 54 and 56 may be terminated or may be applied to the actuators 54 and 56 in an opposite polarity. In any case, the terminated or through a single control signal coupled from the ECM 38 to the valve actuators 54 and 56 through the pair of electrical conductors 74.

Alternatively, it is contemplated that the valve actuators 54 and 56 may have the same general diameter (not shown), but each having electroactive layers of different cross-sectional thicknesses (not shown). The electroactive layer of valve actuator 56 has a cross-sectional thickness that is greater than that of the valve actuator 54 so that the valve actuator 54 will have a maximum displacement at a lower magnitude of the control signal to seat the spill valve 58 before valve actuator 56 seats the needle valve 68.

According to another aspect of the present invention, different electroactive materials are used for each of the valve actuators 54 and 56 that reach maximum displacements in response to different electric field strengths.

For example, valve actuator 54 may be made from PZT5H piezoelectric material that reaches maximum displacement at about 12.5 kV/cm while valve actuator 56 may be made from PZT5A piezoelectric material that reaches maximum displacement at about 21 kV/cm. In this way, the use of different piezoceramic materials for the actuators 54, 56 will result in the valve actuator 54 having a maximum displacement at a lower magnitude of the control signal than the valve actuator 56 so that the spill valve 58 is seated before the needle valve 68.

INDUSTRIAL APPLICABILITY

The thermally pre-stressed bender actuators 54 and 56 of the present invention may provide rapid, accurate, and repeatable controlled movement of the spill valve 54 and DOC poppet valve 84 between their open and closed positions. The bender actuators 54 and 56 of the present invention are generally lightweight, proportional devices having a stroke output that is proportional to the input control signal. Accurate, repeatable bi-directional movement of the spill valve 58 and DOC poppet valve 84 is controlled simply by varying the magnitude and polarity of the control signal applied to the actuators 54 and 56. The valve actuators 54 and 56 are configured and operated so that the reversed control signal allows the valve actuators 54 and 56 to return toward their respective static domed configurations, thereby opening the spill valve 58 and moving the needle control valve member 84 downward to open the fluid passage 104 between the sealing surface 100 and seat 102 whereby fluid communication is again established between the fuel passage 114 and the first pressure control chamber 115 above the upper surface 116 of the DOC piston 118. The application of high fuel pressure to the top of the DOC piston 118 and the force exerted by check spring 66 cause the check 64 to move downwardly such that the check tip 124 engages the seat 126 to close injection orifice 123, thereby preventing further fuel injection. Fuel then circulates through the spill valve 58, the chamber 90 and space 96, the plunger cavity 62, the passages in the plunger (not shown) and the annular recess 98 to drain for cooling purposes as described above.

In accordance with one aspect of the present invention, the valve actuator 54 for controlling movement of the spill valve 58 has a larger diameter than the diameter of the valve actuator 56 for controlling movement of the needle valve 68, as shown in FIGS. 2 and 2A. The diameter of the valve actuator 54 is preferably chosen so that its maximum displacement is more than is needed to seat the spill valve 58. The diameter of valve actuator 58 is preferably chosen so that its maximum displacement generally matches the required stroke to seat the needle valve 68. Therefore, although the valve actuators 54 and 56 are made of the same electroactive material, such as PZT5A piezoelectric ceramic, and have respective electroactive layers of generally the same thickness, the spill valve 58 will become seated in response to a control signal of lower magnitude while the needle valve 68 will remain unseated. When the magnitude of the control signal is increased to a predetermined magnitude, the needle valve 68 becomes seated while the spill valve 58 experiences an increase in its seating force. In this way, non-simultaneous closing of the spill valve 58 and needle valve 68 is controlled spill valve 58 seats before the DOC needle control valve member 84. The bi-directional capability of the actuators 54, 56 eliminates the need for compression springs in the fuel injector 12 to move the spill valve 58 and needle valve 68 to their respective return positions. Further, the bender actuators 54 and 56 of the present invention have fast response times so that dwell time between multiple injection events can be reduced, thereby also reducing variability from injection event to injection event. Additionally, thermally pre-stressed bender actuators 54 and 56 acts as capacitive loads and will remain in their actuated positions for a period of time after the ECM control signal is terminated unlike a solenoid that requires a continuous voltage signal and a current source during its actuation phase. Therefore, the fuel injector 12 of the present invention is generally lighter and requires less power for operation than solenoid-controlled fuel injectors of the past.

Although the operation of the fuel injector has already been described in the case where both electroactive bender actuators are on a single electrical circuit, the present invention can have even more capabilities when the, bender actuators are on separate electric circuits. For instance, separate electric circuits could allow for some end of injection rate shaping. In some cases it might be desirable to reopen the spill valve before the needle valve is closed to end an injection. It has been observed that $NO_x$ emissions can sometimes be reduced if the injection event is allowed to stop via cylinder pressure exceeding fuel injection pressure before the needle valve has closed. In other words, the injection event ends due to a simultaneous increase in cylinder pressure with a fuel pressure drop that occurs before the needle valve has been closed. Those skilled in the art will appreciate that this can be accomplished by reopening the spill control valve to allow for pressure to drop in the fuel injector. The needle valve can then be closed under the action of its return spring and/or by de-energizing its electroactive bender actuator to utilize residual fuel pressure to assist in its closure. However, fuel injection will end before the needle valve closes due to cylinder pressure exceeding fuel pressure.

The fuel injector of the present invention can also have additional capabilities. For instance, by the addition of another cam lobe, the present invention could also produce homogenous charge injection events, which preferably occur when the engine cylinder piston is closer to a bottom position than a top position. These early injections allow for the formation of a relatively homogenous mixture of air and fuel, which is then ignited at or near piston top dead center. The ignition can be due to pressure conditions causing spontaneous ignition or by injecting fuel in a conventional manner near top dead center to ignite the homogenous charge that was produced from an earlier injection event in the engine cycle. In addition, the quick actuators of the present invention can allow for relatively small amounts of fuel to be injected in each injection event and permits multiple such injections that are relatively close in time. Thus, in another example injection sequence it might be desirable to inject a relatively small pilot injection followed by a relatively large quantity main injection, which is then followed by a relatively small post injection event. In addition, such an injection sequence could follow an earlier homogenous charge injection event. Thus, the present invention contemplates multiple injection events during a single engine cycle.

Some front end rate shaping can also be accomplished by the relative timing in the actuation of the individual actuators. For instance, both actuators could be energized to move the respective valves to a closed position relatively simultaneously. In such a case, the needle valve would lift to its open position when fuel pressure was sufficient to exceed the force of the needle valve biasing spring, such that injection would begin at a relatively lower injection pressure. This can produce a ramp or boot shaped front end. In an alternative, the needle control valve actuator could be energized after the fuel was brought to injection pressure levels to cause an injection event to commence at a substantially higher injection pressure. This would correspond to a square front end rate shape. Thus, those skilled in the art will appreciate that when the two bender actuators are one separate electrical circuits, both front and end of injection rate shaping capabilities are present. When both actuators are on a single electrical circuit, only front end rate shaping is available.

Although the fuel injector of the present invention has been illustrated wherein the respective valve members are biased to there open positions when the actuators are at rest, the present invention also contemplates one or both being biased to a closed position when their respective actuators are un-energized or otherwise at rest. For instance, the spill control valve bender actuator could be biased to a position to close the spill valve when in its rest position. In such a case, the bender actuator would need a negative voltage to be opened.

While the present invention has been illustrated by a description of various embodiments, and while these embodiments have been described in considerable detail, it is not the intention to restrict or in any way limit the scope of the appended claims to such detail. Additional advantages and modifications will readily appear to those skilled in the art. For example, separate elements may be integrated into a single component and vice versa, functional aspects may be reversed such as whether fluid pressure is applied or removed so as to cause a particular result, etc. The invention in its broader aspects is, therefore, not limited to the specific details, representative apparatus and method, and illustrative example shown and described. Accordingly, departures may be made from such details without departing from the spirit or scope of the invention.

What is claimed is:

1. A fuel injector comprising:

an injector housing;

a spill control valve member at least partially positioned in said injector housing;

a needle control valve member at least partially positioned in said injector housing;

a first electroactive bender actuator having a bending portion operably coupled to move said spill control valve member; and a second electroactive bender actuator having a bending portion operably coupled to move said needle control valve member.

2. The fuel injector of claim 1 including a plunger at least partially positioned in said injector housing.

3. The fuel injector of claim 2 including a tappet assembly operably coupled to said plunger.

4. A fuel injector comprising:

an injector housing;

a spill control valve member at least partially positioned in said injector housing;

a needle control valve member at least partially positioned in said injector housing;

a first electroactive bender actuator operably coupled to move said spill control valve member;

a second electroactive bender actuator operably coupled to move said needle control valve member; and said first electroactive bender and said second electroactive bender actuator each include a thermally prestressed bender disk that includes a dome shaped portion.

5. The fuel injector of claim 1 including a first peripheral clamp and a second peripheral clamp that are clamped around a peripheral edge of said bending portions of each of said first electroactive bender actuator and said second electroactive bender, respectively.

6. The fuel injector of claim 1 including a needle valve with an upper surface exposed to fluid pressure in a pressure control chamber;

a high pressure fuel passage disposed in said injector housing; and said pressure control chamber being fluidly connected to said high pressure fuel passage when said needle control valve member is in an open position.

7. The fuel injector of claim 6 including a drain disposed in said injector housing; and said needle control chamber being fluidly connected to said drain via a leakage path when said needle control valve member is in said open position.

8. The fuel injector of claim 1 wherein one of said first electroactive bender actuator and said second electroactive bender actuator is positioned between said needle control valve member and said spill control valve member along a centerline of said injector housing.

9. A method of injecting fuel, comprising the steps of:

closing a spill valve at least in part by changing a voltage applied to a first electroactive bender actuator to flex a bending portion of the first electroactive bender actuator; and opening a nozzle outlet at least in part by changing a voltage applied to a second electroactive bender actuator to flex a bending portion of the first electroactive bender actuator.

10. The method of claim 9 including a step of closing the nozzle outlet; and the steps of opening and closing the nozzle outlet are performed a plurality of times in a single engine cycle.

11. The method of claim 9 including a step of closing the nozzle outlet; and the steps of opening and closing the nozzle outlet are performed in an engine cylinder with a piston closer to a bottom position than a top position.

12. The method of claim 9 including a step of closing the nozzle outlet at least in part by exposing a closing hydraulic surface of a needle valve to high pressure fuel.

13. The method of claim 9 including the step of:

closing the nozzle outlet while exposing a hydraulic surface of a needle valve to low pressure fuel.

14. The method of claim 13 wherein said step of closing the nozzle outlet includes the steps of:

opening the spill valve during an injection event; and reducing a magnitude of a voltage applied to the second electroactive bender actuator.

15. The method of claim 9 including the step of:

closing and reopening the nozzle outlet while the spill valve is closed.

16. The method of claim 9 including a step of opening the spill valve; and the step of closing the spill valve is performed a plurality of times in a single engine cycle.

17. The method of claim 9 including a step of moving a plunger via an interaction with a cam.

* * * * *